US009927750B2

(12) United States Patent
Kosaka

(10) Patent No.: US 9,927,750 B2
(45) Date of Patent: Mar. 27, 2018

(54) IMAGE FORMING APPARATUS

(71) Applicant: BROTHER KOGYO KABUSHIKI KAISHA, Nagoya-shi, Aichi-ken (JP)

(72) Inventor: Raizo Kosaka, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/472,906

(22) Filed: Mar. 29, 2017

(65) Prior Publication Data

US 2017/0364007 A1 Dec. 21, 2017

(30) Foreign Application Priority Data

Jun. 17, 2016 (JP) ..... 2016-121271

(51) Int. Cl.
*G03G 15/20* (2006.01)

(52) U.S. Cl.
CPC ..... *G03G 15/2085* (2013.01)

(58) Field of Classification Search
CPC ..... G03G 15/2085; G03G 15/6576; G03G 2215/00662
See application file for complete search history.

(56) References Cited

U.S. PATENT DOCUMENTS 7,298,981 B2 * 11/2007 Oohara ..... G03G 15/2028 399/322
9,075,386 B2 * 7/2015 Uchida ..... G03G 21/1633
9,316,966 B2 * 4/2016 Kondo ..... G03G 15/2028

FOREIGN PATENT DOCUMENTS

JP S-63-293576 A 11/1988
JP H04-204471 A 7/1992
JP H05-72938 A 3/1993
JP H10-186916 A 7/1998
JP 2014-063003 A 4/2014

* cited by examiner

*Primary Examiner* — Gregory H Curran
(74) *Attorney, Agent, or Firm* — Merchant & Gould P.C.

(57) ABSTRACT

An electrophotographic image forming apparatus, including: a fixing device including a heater and a presser; a discharge-roller unit including a first frame and a discharge roller pair; and an arm supporting the heater or the presser, wherein, when the first frame is located at a first position, a nip position of the discharge roller pair is located at a first nip position and the arm supports the heater or the presser at a first press-contact position such that the heater and the presser are held in pressing contact at a predetermined pressure, and wherein, when the first frame is located at a second position, the nip position is located at a second nip position shifted from the first nip position and the arm supports the heater or the presser at a second press-contact position such that the heater and the presser are held in pressing contact at a lower pressure.

8 Claims, 5 Drawing Sheets

IMAGE FORMING APPARATUS

CROSS REFERENCE TO RELATED APPLICATION

The present application claims priority from Japanese Patent Application No. 2016-121271, which was filed on Jun. 17, 2016, the disclosure of which is herein incorporated by reference in its entirety.

BACKGROUND

Technical Field

The following disclosure relates to an image forming apparatus which enables a reduction of curl of a sheet generated after a toner image formed on the sheet has been thermally fixed.

Description of Related Art

A known image forming apparatus includes: conveyance rollers disposed downstream of a nip position between a heating roller and a presser roller in a conveyance direction of a recording sheet and including a first roller and a second roller between which the recording sheet is conveyed after a toner image formed thereon has been thermally fixed; and a roller moving mechanism configured to move the conveyance rollers with respect to the nip position between a first conveyance position and a second conveyance position at which a positional relationship with the nip position is different from a positional relationship with the nip position at the first conveyance position. The roller moving mechanism includes an operation member and is rendered operable by operating the operation member. The roller moving mechanism and a nip-pressure adjuster configured to allow the presser roller to move with respect to the heating roller are configured to be operated independently of each other by operating the operation member of the roller moving mechanism and a lever of the nip-pressure adjuster, respectively.

SUMMARY

In the known image forming apparatus, the curl of the sheet is reduced by operating the lever so as to render the nip-pressure adjuster operable and by operating the operation member so as to render the roller moving mechanism operable. In the known image forming apparatus, however, the lever of the nip-pressure adjuster and the operation member of the roller moving mechanism need to be operated separately or independently of each other for reducing the curl of the sheet, undesirably requiring a cumbersome operation for enabling a reduction of curl of the sheet.

In view of the situation described above, there has been a demand for an image forming apparatus which enables a reduction of the curl of the sheet with a simple operation.

An aspect of the present disclosure provides an image forming apparatus, including: a fixing device including a heater and a presser; a discharge-roller unit including a first frame configured to be movable between a first position and a second position and a discharge roller pair supported by the first frame, the discharge roller pair including a first roller disposed so as to come into contact with one surface of a sheet that has contacted the heater and a second roller disposed so as to come into contact with the other surface of the sheet that has contacted the presser; and an arm supporting one of the heater and the presser while being coupled to the first frame, the arm being configured to move the one of the heater and the presser in accordance with a movement of the first frame, wherein, when the first frame is located at the first position, a nip position of the discharge roller pair is located at a first nip position and the arm supports the one of the heater and the presser at a first press-contact position so as to permit the heater and the presser to be held in pressing contact with each other at a predetermined pressure, and wherein, when the first frame is located at the second position, the nip position of the discharge roller pair is located at a second nip position which is shifted from the first nip position in a direction from the heater toward the presser, and the arm supports the one of the heater and the presser at a second press-contact position so as to permit the heater and the presser to be held in pressing contact with each other at a pressure lower than the predetermined pressure.

BRIEF DESCRIPTION OF THE DRAWINGS

The objects, features, advantages, and technical and industrial significance of the present disclosure will be better understood by reading the following detailed description of one embodiment, when considered in connection with the accompanying drawings, in which.

DETAILED DESCRIPTION OF THE EMBODIMENT

Figure 1:
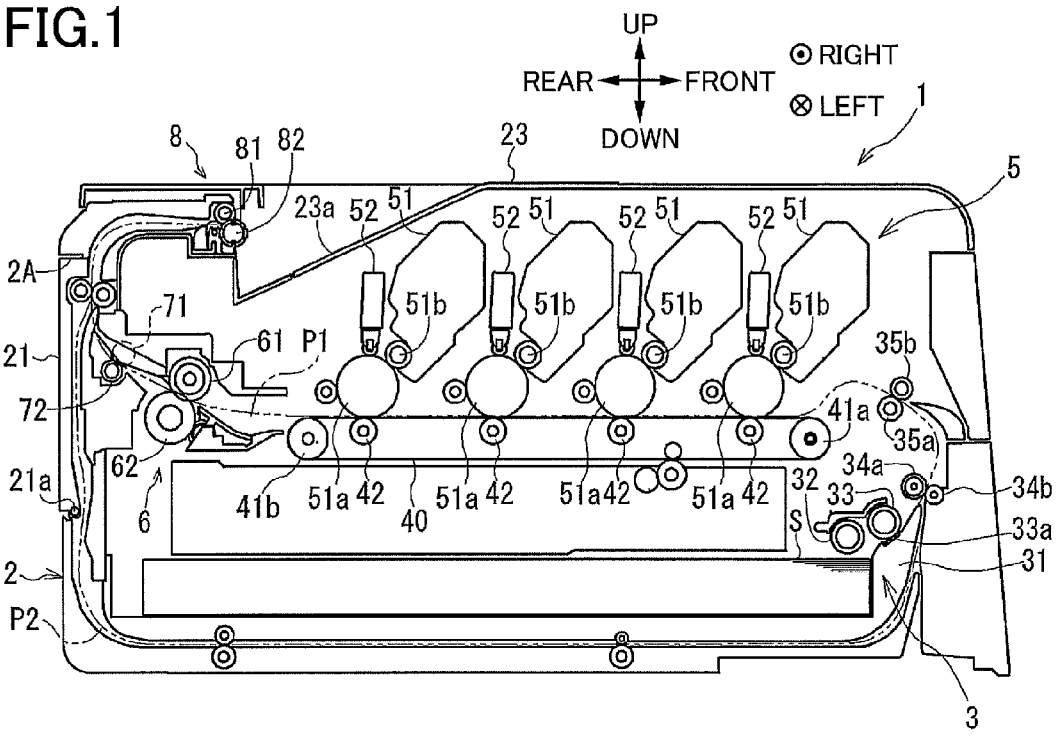
FIG. 1 is a vertical central cross-sectional view of an image forming apparatus.
Figure 2:
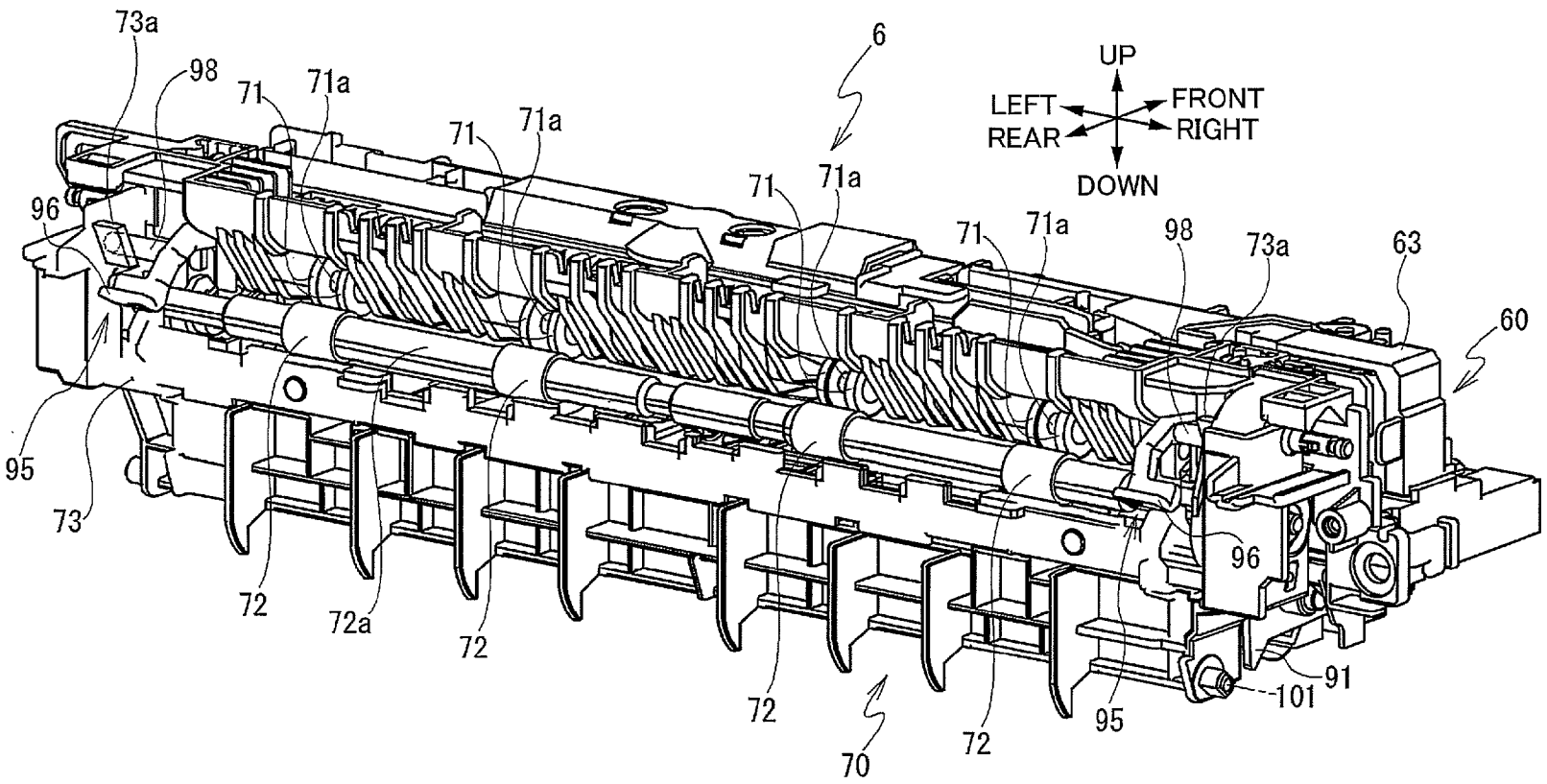
FIG. 2 is a perspective view of a fixing portion of the image forming apparatus.
Figure 3:
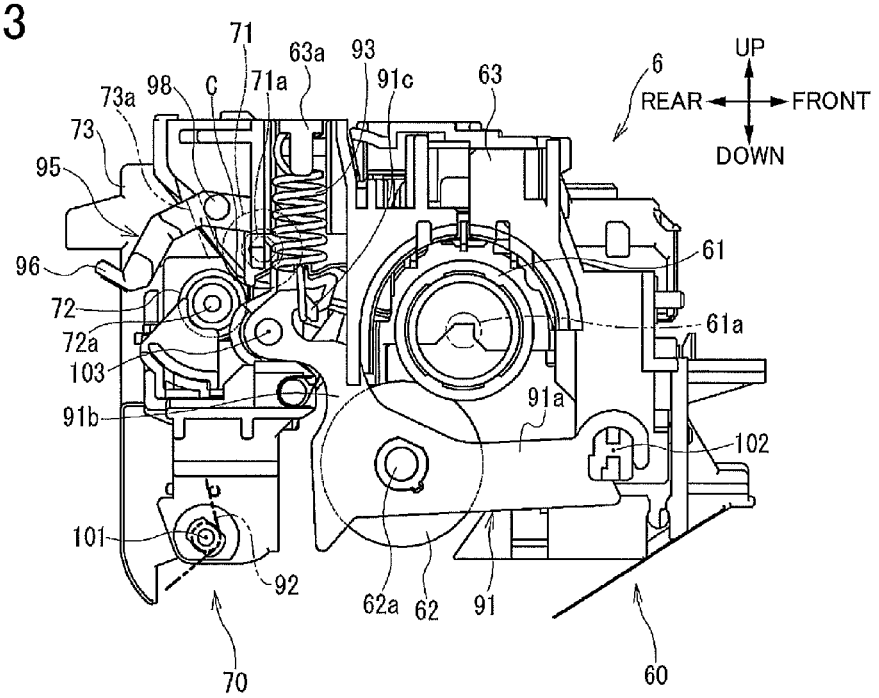
FIG. 3 is a side view of the fixing portion.

There will be explained one embodiment referring to the drawings.

Overall Structure of Image Forming Apparatus

An image forming apparatus 1 shown in FIG. 1 according to one embodiment is an electrophotographic laser color printer configured to form an image in a plurality of colors on a sheet S such as paper or an OHP film.

In the following explanation, a left side and a right side in FIG. 1 are respectively defined as a rear side and a front side of the image forming apparatus 1. A side corresponding to a front surface of the drawing sheet of FIG. 1 and a side corresponding to a back surface of the drawing sheet of FIG.

1 are respectively defined as a right side and a left side of the image forming apparatus 1. Further, an upper side and a lower side in FIG. 1 are respectively defined as an upper side and a lower side of the image forming apparatus 1.

The image forming apparatus 1 includes a housing 2, a sheet supply portion 3 configured to supply the sheet S, an image forming portion 5 configured to form an image on the sheet S, and a sheet discharge portion 8 configured to discharge, to an outside of the housing 2, the sheet S on which an image has been formed.

The housing 2 is shaped like a box having a generally rectangular parallelepiped shape and houses the sheet supply portion 3, the image forming portion 5, and the sheet discharge portion 8. The housing 2 has: an opening 2A which is open to a rear surface of the housing 2; and a rear sheet-discharge tray 21 configured to open and close the opening 2A.

The rear sheet-discharge tray 21 is pivotable about a pivotal shaft 21*a* disposed at a lower end of the rear sheet-discharge tray 21 and extending horizontally in the right-left direction. The rear sheet-discharge tray 21 is pivotable between a closed position at which the opening 2A is closed and an open position at which the opening 2A is opened. When the rear sheet-discharge tray 21 is located at the open position, the sheet S on which an image has been formed and which is to be discharged to the outside of the housing 2 through the opening 2A is supported on the rear sheet-discharge tray 21. The rear sheet-discharge tray 21 is one example of a cover configured to be pivotable between the closed position at which the opening 2A is closed and the open position at which the opening 2A is opened.

An upper portion of the housing 2 is covered by an upper cover 23. A sheet discharge tray 23*a* is formed on an upper surface of the upper cover 23. The sheet discharge tray 23*a* is formed as a recess which is inclined downward in a direction from the front side toward the rear side.

The sheet supply portion 3 includes a sheet cassette 31, a sheet supply roller 32, a separation roller 33, a separator pad 33*a*, a pair of conveyance rollers 34*a*, 34*b*, and a pair of registering rollers 35*a*, 35*b*. There is formed, in the housing 2, a conveyance passage P1 extending from the sheet cassette 31 to the sheet discharge tray 23*a* via the image forming portion 5.

The sheet cassette 31 stores a plurality of sheets S in a stacked state. The sheets S stored in the sheet cassette 31 are supplied one by one by the sheet supply roller 32, the separation roller 33, and the separator pad 33*a* to the conveyance passage P1. The sheet S supplied to the conveyance passage P1 is conveyed by the pair of conveyance rollers 34*a*, 34*b* and the pair of registering rollers 35*a*, 35*b* to the image forming portion 5.

The image forming portion 5 is disposed above the sheet supply portion 3 and includes four drum units 51 arranged in the front-rear direction. The four drum units 51 respectively correspond to four colors, i.e., black, yellow, magenta, and cyan. Each drum unit 51 includes a photoconductive drum 51*a* and a developing roller 51*b*. The image forming portion 5 includes four exposure LED heads 52 corresponding to the respective four colors and a fixing portion 6 disposed downstream of the photoconductive drums 51*a* in a conveyance direction of the sheet S. (The conveyance direction of the sheet S will be hereinafter referred to as "sheet conveyance direction".)

A transfer belt 40 is disposed below the image forming portion 5 with the conveyance passage P1 interposed therebetween. The transfer belt 40 is looped over a drive roller 41*a* and a driven roller 41*b* disposed rearward of the drive roller 41*a*. Four transfer rollers 42 are provided such that each transfer roller 42 is disposed so as to be opposed to a corresponding one of the photoconductive drums 51*a* with the transfer belt 40 interposed therebetween.

In the thus constructed image forming portion 5, each photoconductive drum 51*a* charged uniformly by a charger is selectively exposed by the corresponding exposure LED head 52, and electric charges are selectively removed by the exposure from the surface of the photoconductive drum 51*a*, so that an electrostatic latent image is formed on the surface of the photoconductive drum 51*a*.

A developing bias is applied to each developing roller 51*b*. When the electrostatic latent image formed on each photoconductive drum 51*a* is opposed to the corresponding developing roller 51*b*, toner is supplied from the developing roller 51*b* to the electrostatic latent image owing to a potential difference between the electrostatic latent image and the developing roller 51*b*. Thus, a toner image is formed on the surface of the photoconductive drum 51*a*.

When the sheet S conveyed to the image forming portion 5 reaches the transfer belt 40, the sheet S is conveyed by the transfer belt 40 and passes under the photoconductive drums 51*a* sequentially. When the toner image on each photoconductive drum 51*a* is opposed to the sheet S, the toner image is transferred to the sheet S by a transfer bias applied to the corresponding transfer roller 42.

The sheet S on which the toner image has been transferred is conveyed to the fixing portion 6. The fixing portion 6 includes a heating roller 61 and a presser roller 62 that is held in pressing contact with the heating roller 61. In the fixing portion 6, the toner image on the sheet S is thermally fixed during passage between the heating roller 61 and the presser roller 62. The heating roller 61 is one example of "heater", and the presser roller 62 is one example of "presser". Further, the heating roller 61 and the presser roller 62 constitute a "fixing device".

The fixing portion 6 includes a first discharge roller 71 and a second discharge roller 72 which constitute a discharge roller pair and which are disposed downstream of the heating roller 61 and the presser roller 62 in the sheet conveyance direction. The sheet S on which the toner image has been thermally fixed is conveyed downstream while being nipped by the first discharge roller 71 and the second discharge roller 72. The first discharge roller 71 is one example of "first roller", and the second discharge roller 72 is one example of "second roller". While the fixing portion 6 includes a plurality of discharge rollers 71 and a plurality of discharge rollers 72, the following explanation will be made focusing on one discharge roller 71 and one discharge roller 72 for the sake of brevity.

The sheet S conveyed downstream by the first discharge roller 71 and the second discharge roller 72 is further conveyed by a pair of discharge rollers 81, 82 and is then discharged to the sheet discharge tray 23*a* of the upper cover 23.

In the image forming apparatus 1, a return passage P2 is formed for again conveying, to the image forming portion 5, the sheet S on which an image has been formed on its one surface by the image forming portion 5 and which has been discharged from the fixing portion 6. The image forming portion 5 forms an image on the other surface of the sheet S which has been again conveyed to the image forming portion 5 through the return passage P2. Thereafter, the sheet S is discharged to the sheet discharge tray 23*a* by the sheet discharge portion 8. Thus, the image forming apparatus 1 according to the present embodiment is configured to perform duplex printing. That is, the sheet S, in which an image has been formed on its one surface by the image forming portion 5, is again conveyed to the image forming portion 5 through the return passage P2, and an image is formed on the other surface of the sheet S by the image forming portion 5.

Fixing Portion

The fixing portion 6 will be next explained in detail. As shown in FIGS. 2-5, the fixing portion 6 includes a fixing unit 60 (as one example of "fixing device"), a discharge-roller unit 70, arms 91, and operation arms 95.

The fixing unit 60 includes: a first rotation shaft 61*a* which is horizontally disposed so as to extend in the right-left direction of the image forming apparatus 1; the heating roller 61 configured to be rotatable about a first rotation axis defined by the first rotation shaft 61*a*; a second rotation shaft 62*a* which is disposed in parallel with the first rotation shaft 61*a*; the presser roller 62 configured to be rotatable about a second rotation axis defined by the second rotation shaft 62*a*; and a heating-roller support frame 63 (as one example of "second frame") supporting the first rotation shaft 61*a*.

The heating-roller support frame 63 is a frame member extending in the right-left direction at a rear portion of the housing 2. The first rotation shaft 61*a* is supported by the heating-roller support frame 63, whereby the heating roller 61 is rotatably supported by the heating-roller support frame 63 about the first rotation axis defined by the first rotation shaft 61*a*.

The heating roller 61 and the presser roller 62 are disposed such that a conveyor surface (an outer circumferential surface) of the heating roller 61 for conveying the sheet S and a conveyor surface (an outer circumferential surface) of the presser roller 62 for conveying the sheet S are opposed to each other and such that the conveyor surface of the presser roller 62 is held in pressing contact with the conveyor surface of the heating roller 61. The sheet S which has been conveyed to the fixing portion 6 and on which the toner image has been formed is conveyed by the heating roller 61 and the presser roller 62 while being nipped therebetween, so that the toner image formed on the sheet S is thermally fixed.

In the fixing portion 6 of the present embodiment, the toner image formed on the sheet S is heated by the heating roller 61 as a roller member. There may be employed, as a heating member for heating the toner image, a heating plate configured to form a pressure nip with the presser roller 62 via a fixing film and to be heated by a heater. Further, the presser roller 62 may be a member other than the roller member.

The discharge-roller unit 70 includes: a third rotation shaft 71*a* disposed downstream of the fixing unit 60 in the sheet conveyance direction so as to be in parallel with the first rotation shaft 61*a*; the first discharge roller 71 configured to be rotatable about a third rotation axis defined by the third rotation shaft 71*a*; a fourth rotation shaft 72*a* disposed in parallel with the third rotation shaft 71*a*; the second discharge roller 72 configured to be rotatable about a fourth rotation axis defined by the fourth rotation shaft 72*a*; and a discharge-roller support frame 73 (as one example of "first frame") supporting the third rotation shaft 71*a* and the fourth rotation shaft 72*a*.

The discharge-roller support frame 73 is a frame member extending in the right-left direction on the rear side of the heating-roller support frame 63 in the housing 2. The third rotation shaft 71*a* and the fourth rotation shaft 72*a* are supported by the discharge-roller support frame 73, whereby the first discharge roller 71 and the second discharge roller 72 are supported by the discharge-roller support frame 73 so as to be respectively rotatable about the third rotation axis defined by the third rotation shaft 71*a* and the fourth rotation axis defined by the fourth rotation shaft 72*a*. The discharge-roller support frame 73 is one example of "first frame" supporting the discharge roller pair.

The first discharge roller 71 and the second discharge roller 72 are disposed such that a conveyor surface (an outer circumferential surface) of the first discharge roller 71 for conveying the sheet S and a conveyor surface (an outer circumferential surface) of the second discharge roller 72 for conveying the sheet S are opposed to each other. The sheet S which has been discharged from the fixing unit 60 is conveyed downstream in the sheet conveyance direction by the first discharge roller 71 and the second discharge roller 72 while being nipped therebetween. That is, the first discharge roller 71 is disposed so as to come into contact with a surface of the sheet S that has contacted the heating roller 61, and the second discharge roller 72 is disposed so as to come into contact with a surface of the sheet S that has contacted the presser roller 62. Hereinafter, a position at which the sheet S is nipped by the first discharge roller 71 and the second discharge roller 72 of the discharge roller pair will be referred to as a nip position C.

Figure 4:
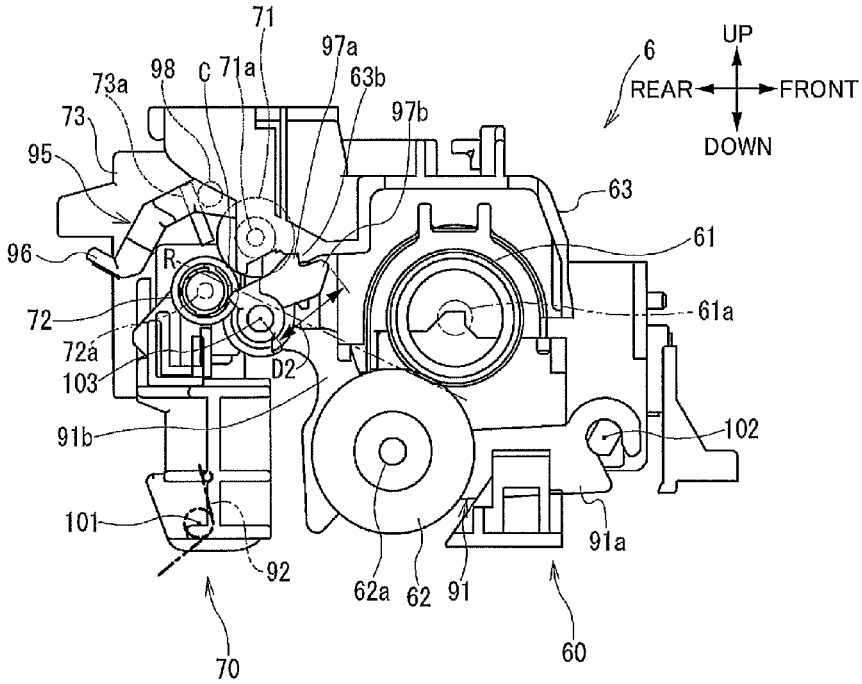
FIG. 4 is a side view in cross section of the fixing portion in a state in which a discharge-roller support frame is located at a first position.

In the fixing portion 6, the nip position C of the first discharge roller 71 and the second discharge roller 72 is changeable between a first nip position (FIG. 4) which is located downstream of the fixing unit 60 in the sheet conveyance direction and a second nip position (FIG. 5) which is shifted from the first nip position shown in FIG. 4 in a direction from the heating roller 61 toward the presser roller 62.

The discharge-roller support frame 73 is pivotable about a first axis 101 located at its lower end and parallel to the first rotation axis defined by the first rotation shaft 61*a*. The first axis 101 is one example of "axis" about which the discharge-roller support frame 73 (as one example of "first frame") is pivotable.

The discharge-roller support frame 73 is configured to pivot about the first axis 101 so as to be movable between a first position and a second position. The discharge-roller support frame 73 takes an upright posture (FIG. 4) when located at the first position and takes a posture rearwardly inclined about the first axis 101 (FIG. 5) when located at the second position.

In the thus constructed fixing portion 6, when the discharge-roller support frame 73 pivots about the first axis 101 so as to be located at the first position, the nip position C is located at the first nip position. When the discharge-roller support frame 73 pivots about the first axis 101 so as to be located at the second position, the nip position C is located at the second nip position.

The fixing portion 6 includes a first biasing member 92 biasing the discharge-roller support frame 73 in a direction in which first discharge roller 71 and the second discharge roller 72 move about the first axis 101 toward the fixing unit 60, namely, in a direction in which the discharge-roller support frame 73 pivots from the second position to the first position. The first biasing member 92 is a torsion spring, for instance.

The arms 91 are plate members disposed at one and the other of right and left end portions of the fixing portion 6. The arms 91 are respectively supported at right and left ends of the discharge-roller support frame 73, so as to be pivotable about a second axis 102 which is parallel to the first rotation axis of the first rotation shaft 61*a*. The second axis 102 is located upstream of the press-contact position of the heating roller 61 and the presser roller 62 in the sheet conveyance direction. The following explanation will be made focusing on one arm 91 for the sake of brevity. The arm 91 includes a roller support portion 91*a* extending rearward from the second axis 102 and an operation-arm support portion 91*b* extending obliquely upward and rearward from a rear end of the roller support portion 91*a*.

The roller support portion 91*a* of the arm 91 supports the second rotation shaft 62*a*. The second rotation shaft 62*a* is supported by the roller support portion 91*a*, whereby the presser roller 62 is supported by the roller support portion 91*a* so as to be rotatable abut the second rotation axis defined by the second rotation shaft 62*a*. When the arm 91 pivots about the second axis 102, the presser roller 62 rotates about the second axis 102, so that the presser roller 62 moves toward and away from the first rotation shaft 61*a* of the heating roller 61. When the presser roller 62 moves toward and away from the first rotation shaft 61*a* of the heating roller 61, the press-contact state of the presser roller 62 and the heating roller 61 changes.

The arm 91 is configured to pivot about the second axis 102 so as to be movable between: a position at which the arm 91 supports the presser roller 62 at a first press-contact position at which the presser roller 62 is held in pressing contact with the heating roller 61 at a predetermined pressure; and a position at which the arm 91 supports the presser roller 62 at a second press-contact position at which the presser roller 62 is held in pressing contact with the heating roller 61 at a pressure lower than the predetermined pressure. Further, the arm 91 is configured to move the presser roller 62 between the first press-contact position and the second press-contact position in accordance with the movement of the discharge-roller support frame 73 between the first position and the second position.

A spring holder 91*c* is formed at an upper end of the operation-arm support portion 91*b* of the arm 91, and a spring holder 63*a* is formed at a position of the heating-roller support frame 63 located above the spring holder 91*c*. A second biasing member 93 is interposed between the spring holder 91*c* and the spring holder 63*a*.

The second biasing member 93 is disposed downstream, in the sheet conveyance direction, of a press-contact portion at which the heating roller 61 and the presser roller 62 are held in pressing contact with each other, such that the second biasing member 93 is located between the arm 91 and the heating-roller support frame 63. The second biasing member 93 biases the arm 91 in a direction in which the presser roller 62 moves about the second axis 102 toward the heating roller 61, namely, in a direction in which the presser roller 62 pivots from the second press-contact position to the first press-contact position. The second biasing member 93 is a tension coil spring, for instance.

Each operation arm 95 is supported by the operation-arm support portion 91*b* of the corresponding arm 91 so as to be pivotable about a third axis 103 parallel to the first rotation axis of the first rotation shaft 61*a*. The third axis 103 is located at a position which is located above the operation-arm support portion and 91*b* which is downstream, in the sheet conveyance direction, of the press-contact portion at which the heating roller 61 and the presser roller 62 are held in pressing contact with each other. The following explanation will be made focusing on one operation arm 95 for the sake of brevity.

The operation arm 95 includes a first cam 97*a* protruding outward from the third axis 103 by a distance D1 and a second cam 97*b* protruding outward from the third axis 103 by a distance D2 larger than the distance D1, in a direction which is out of phase with respect to the direction of protrusion of the first cam 97*a*. The heating-roller support frame 63 has a stopper portion 63*b*, and the first cam 97*a* and the second cam 97*b* are configured to come into engagement with the stopper portion 63*b*. That is, the first cam 97*a* and the second cam 97*b* selectively come into engagement with the stopper portion 63*b*.

The pivot position of the arm 91 about the second axis 102 and the position of the presser roller 62 supported by the arm 91 differ between when the first cam 97*a* is held in engagement with the stopper portion 63*b* and when the second cam 97*b* is held in engagement with the stopper portion 63*b*. When the first cam 97*a* is held in engagement with the stopper portion 63*b*, the arm 91 supports the presser roller 62 at the first press-contact position (FIG. 4) at which the presser roller 62 is held in pressing contact with the heating roller 61 at the predetermined pressure.

When the second cam 97*b* is held in engagement with the stopper portion 63*b*, the arm 91 supports the presser roller 62 at the second press-contact position (FIG. 5) at which the presser roller 62 is held in pressing contact with the heating roller 61 at the pressure lower than the predetermined pressure. In the present embodiment, the distance D2 by which the second cam 97*b* protrudes is larger than the distance D1 by which the first cam 97*a* protrudes. Thus, in a state in which the second cam 97*b* is held in engagement with the stopper portion 63*b*, the presser roller 62 is located at a position shifted from the first press-contact position in a direction in which the presser roller 62 moves away from the heating roller 61. As a result, the presser roller 62 is held in pressing contact with the heating roller 61 at the pressure lower than the predetermined pressure.

The arm 91 is biased by the second biasing member 93 in a direction in which the first cam 97*a* or the second cam 97*b* is held in engagement with the stopper portion 63*b*. Consequently, the state in which the first cam 97*a* is held in engagement with the stopper portion 63*b* or the state in which the second cam 97*b* is held in engagement with the stopper portion 63*b* are maintained by the biasing force of the second biasing member 93.

The operation arm 95 extends rearward from the third axis 103 and has a lever 96 configured to be pivotable about the third axis 103 together with the first cam 97*a* and the second cam 97*b*. The third axis 103 is one example of "pivot axis". The lever 96 is manually operable by the user of the image forming apparatus 1. That is, the user operates the lever 96 in the up-down direction, whereby the operation arm 95 is moved between a position (FIG. 4) at which the first cam 97*a* is held in engagement with the stopper portion 63*b* and a position (FIG. 5) at which the second cam 97*b* is held in engagement with the stopper portion 63*b*.

The lever 96 of the operation arm 95 has an engagement boss 98 protruding therefrom in the right-left direction, and the discharge-roller support frame 73 has an engagement pieces 73*a* configured to engage the engagement boss 98. The engagement boss 98 pivots about the third axis 103 in accordance with the pivot position of the lever 96. The engagement boss 98 is one example of "position keeper" configured to come into engagement with the discharge-roller support frame 73 so as to keep the discharge-roller support frame 73 at one of the first position and the second position.

The engagement piece 73*a* and the engagement boss 98 come into engagement with each other, so that the arm 91 and the discharge-roller support frame 73 are connected to each other via the operation arm 95. Further, the engagement of the engagement piece 73*a* and the engagement boss 98 determines the pivot position, about the first axis 101, of the discharge-roller support frame 73 biased by the first biasing member 92.

For instance, when the operation arm 95 is located at the pivot position at which the first cam 97*a* is held in engagement with the stopper portion 63*b*, the discharge-roller support frame 73 is kept at the first position by the engagement of the engagement piece 73*a* and the engagement boss 98. In this instance, because the first cam 97*a* is held in engagement with the stopper portion 63*b*, the arm 91 supports the presser roller 62 at the first press-contact position and the discharge-roller support frame 73 is kept at the first position, so that the nip position C is located at the first nip position.

When the operation arm 95 is located at the pivot position at which the second cam 97*b* is held in engagement with the stopper portion 63*b*, the discharge-roller support frame 73 is kept at the second position by the engagement of the engagement piece 73*a* and the engagement boss 98. In this instance, because the second cam 97*b* is held in engagement with the stopper portion 63*b*, the arm 91 supports the presser roller 62 at the second press-contact position and the discharge-roller support frame 73 is kept at the second position, so that the nip position C is located at the second nip position.

In the thus constructed fixing portion 6, when the discharge-roller support frame 73 is located at the first position, the nip position C of the discharge roller pair is located at the first nip position and the arm 91 supports the presser roller 62 at the first press-contact position. When the discharge-roller support frame 73 is located at the second position, the nip position C of the discharge roller pair is located at the second nip position and the arm 91 supports the presser roller 62 at the second press-contact position.

Thus, by moving the operation arm 95 between the position at which the first cam 97*a* is held in engagement with the stopper portion 63*b* and the position at which the second cam 97*b* is held in engagement with the stopper portion 63*b*, switching of the nip position C of the discharge roller pair between the first nip position and the second nip position and switching of the press-contact position of the presser roller 62 between the first press-contact position and the second press-contact position can be performed in conjunction with each other through the arm 91. This configuration enables a reduction in an amount of curl of the sheet S after the image has been fixed thereon without performing a switching operation of the press-contact position of the presser roller 62 and a switching operation of the nip position C of the discharge roller pair independently of each other. It is thus possible to simplify an operation for enabling a reduction in the curl amount of the sheet S.

In the present embodiment, the heating-roller support frame 63 supports the heating roller 61 while the arm 91 supports the presser roller 62, and the presser roller 62 is moved between the first press-contact position and the second press-contact position by the pivotal movement of the arm 91. The heating-roller support frame 63 may support the presser roller 62 while the arm 91 may support the heating roller 61. In this case, the heating roller 61 is configured to be moved by the pivotal movement of the arm 91 between a first press-contact position at which the heating roller 61 and the presser roller 62 are held in pressing contact at a predetermined pressure and a second press-contact position at which the heating roller 61 and the presser roller 62 are held in pressing contact with each other at a pressure lower than the predetermined pressure.

Figure 5:
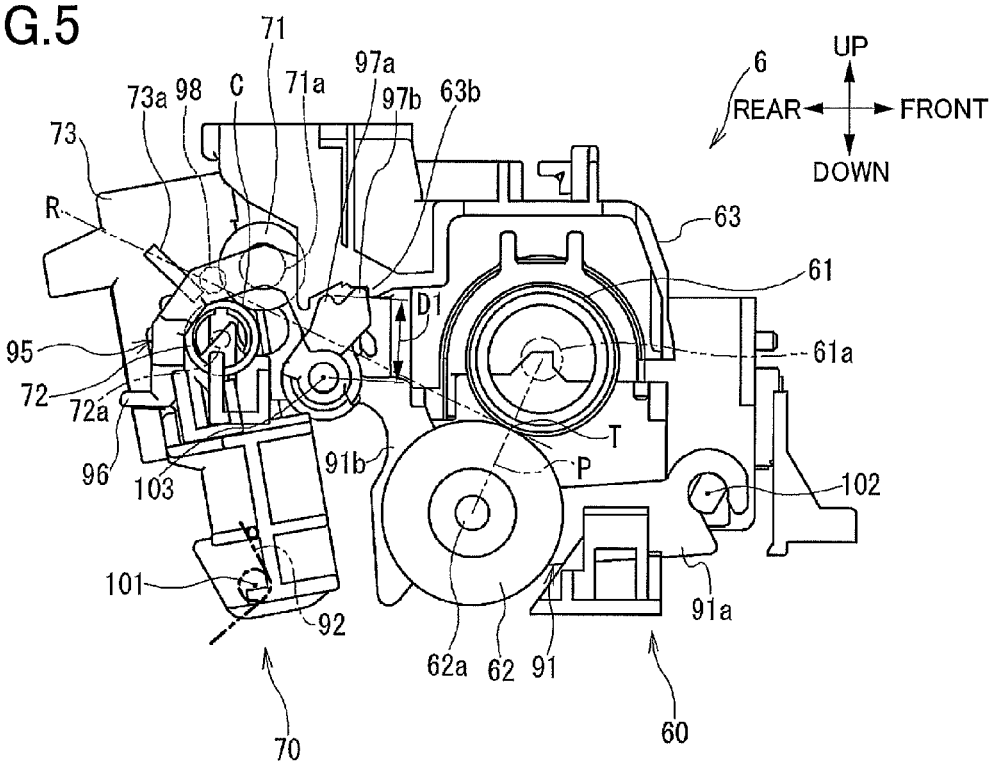
FIG. 5 is a side view in cross section of the fixing portion in a state in which the discharge-roller support frame is located at a second position.

Here, a reference plane R is defined as a plane (1) which is perpendicular to a plane P that includes the first axis defined by the first rotation shaft 61*a* as an axis of the heating roller 61 and the second axis defined by the second rotation shaft 62*a* as an axis of the presser roller 62 in a state in which the arm 91 supports the presser roller 62 at the second press-contact position and (2) which includes a contact point T (contact line) at which the heating roller 61 and the presser roller 62 are in contact with each other. In the fixing portion 6 of the present embodiment, the first nip position is located on one side of the reference plane R that is nearer to the heating roller 61 (FIG. 4), and the second nip position is located at a position at which a distance between the second nip position and the reference plane R is smaller than a distance between the first nip position and the reference plane R (FIG. 5).

The sheet S nipped by the heating roller 61 and the presser roller 62 so as to be conveyed downstream thereof is heated by the heating roller 61 on its one surface that contacts the heating roller 61, and the sheet S curls so as to protrude toward a heating-roller side. Thus, the sheet S nipped by the first discharge roller 71 and the second discharge roller 72 is conveyed more straightly when the nip position C is located at the second nip position at which the distance between the second nip position and the reference plane R is smaller than the distance between the first nip position and the reference plane R, than when the nip position C is located at the first nip position which is located on one side of the reference plane R that is nearer to the heating roller 61. It is consequently possible to reduce the curl amount of the sheet S.

In the present embodiment, the second nip position is located on the other side of the reference plane R that is nearer to the presser roller 62. The second nip position may be located on the one side of the reference plane R that is nearer to the heating roller 61 as long as the distance between the second nip position and the reference plane R is smaller than the distance between the first nip position and the reference plane R. Also in this configuration, the sheet S is conveyed in a state in which the nip position C is located at the thus set second nip position, whereby the curl amount of the sheet S can be reduced.

Switching of Sheet Discharge Direction by Switching of Nip Position of Discharge Roller Pair In the image forming apparatus 1 of the present embodiment, the rear sheet-discharge tray 21 disposed at the back of the housing 2 is opened so as to open the opening 2A, whereby the sheet S conveyed downstream by the first discharge roller 71 and the second discharge roller 72 can be discharged to the rear sheet-discharge tray 21 through the opening 2A.

The discharging of the sheet S by the first discharge roller 71 and the second discharge roller 72 to the rear sheet-discharge tray 21 may be configured to be performed when the nip position C of the discharge roller pair is located at the second nip position. In this case, the sheet S conveyed downstream by the first discharge roller 71 and the second discharge roller 72 may be configured to be discharged to the sheet discharge tray 23*a* formed on the upper cover 23 and disposed above the fixing portion 6 when the nip position C of the discharge roller pair is located at the first nip position.

In the image forming apparatus 1 of the present embodiment, the first nip position is set to a position that enables smooth conveyance of the sheet S when the sheet S conveyed by the first discharge roller 71 and the second discharge roller 72 is discharged to the sheet discharge tray 23*a*. Therefore, the sheet S conveyed by the first discharge roller 71 and the second discharge roller 72 is configured to be discharged to the sheet discharge tray 23*a* when the nip position C is located at the first nip position, ensuring good conveyance of the sheet S.

On the other hand, when the nip position C is located at the second nip position, the sheet S conveyed downstream by the first discharge roller 71 and the second discharge roller 72 may be discharged to the rear sheet-discharge tray 21 disposed rearward of the first discharge roller 71 and the second discharge roller 72. In this case, the sheet S is straightly discharged to the outside of the housing 2 without being largely bent. It is consequently possible to appropriately convey the sheet S when the nip position C is located at the second nip position.

Guide

Figure 6:
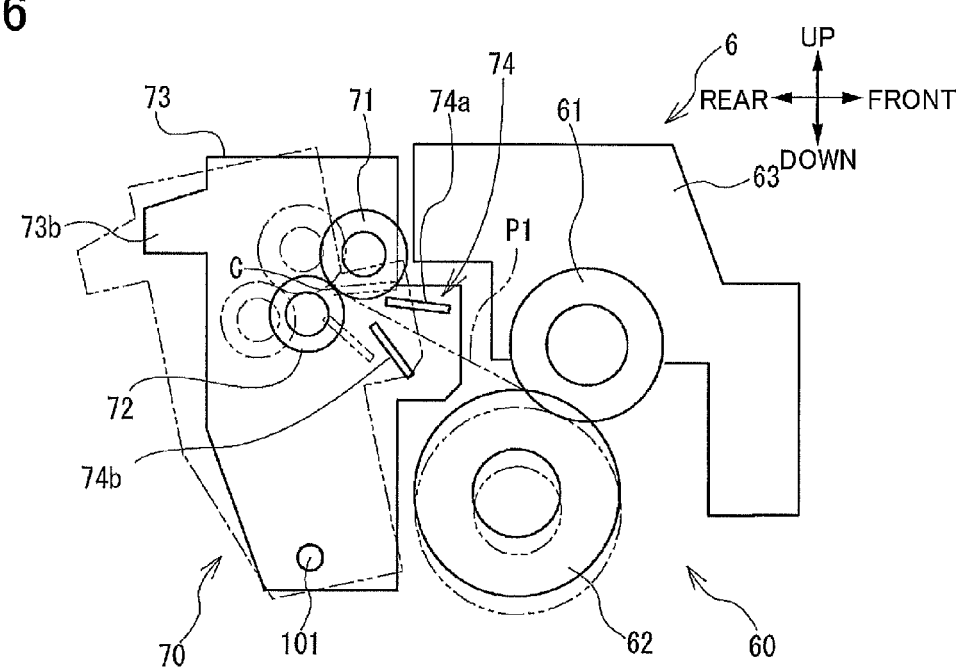
FIG. 6 is a side view of the fixing portion in which the discharge-roller support frame has a guide for guiding a sheet.

As shown in FIG. 6, the discharge-roller support frame 73 includes a guide 74 for guiding the sheet S, which has been discharged from the fixing unit 60 and which is to be conveyed to the discharge-roller unit 70, to the nip position C of the discharge roller pair. The guide 74 is disposed upstream of the nip position C in the sheet conveyance direction. In FIG. 6, the arm 91 is not illustrated.

The guide 74 includes: a first guide member 74*a* disposed on one side of a portion of the conveyance passage P1 ranging from the press-contact portion, at which the heating roller 61 and the presser roller 62 are held in pressing contact with each other, to the nip position C, which one side is nearer to the heating roller 61; and a second guide member 74*b* disposed on the other side of the portion of the conveyance passage P1 that is nearer to the presser roller 62. The guide 74 is constructed such that a distance between the first guide member 74*a* and the second guide member 74*b* gradually becomes smaller toward the downstream side in the sheet conveyance direction.

The sheet S discharged from the fixing unit 60 is guided to the nip position C by the thus constructed guide 74, whereby the sheet S can be smoothly conveyed while being nipped by the first discharge roller 71 and the second discharge roller 72.

The guide 74 is formed integrally with the discharge-roller support frame 73 by which the first discharge roller 71 and the second discharge roller 72 are supported. Thus, when the discharge-roller support frame 73 pivots about the first axis 101, the relative position between the guide 74 and the nip position C does not change. In other words, the positional relationship between the guide 74 and the nip position C is constant irrespective of the pivot position of the discharge-roller support frame 73.

As described above, when the discharge-roller support frame 73 pivots from the first position to the second position and the nip position C is accordingly changed from the first nip position to the second nip position, the position of the guide 74 also changes with the nip position C. Consequently, even when the nip position C changes, the positional relationship between the guide 74 and the nip position C does not change, so that the quality of conveyance of the sheet S is not deteriorated.

Pushing-Operation Receiving Portion of Discharge-Roller Support Frame

As shown in FIG. 6, the discharge-roller support frame 73 may have a pushing-operation receiving portion 73*b*. The pushing-operation receiving portion 73*b* is configured to receive a pushing operation performed thereon, thereby pivoting the discharge-roller support frame 73 about the first axis 101.

For instance, when the pushing-operation receiving portion 73*b* is pushed rearward in a state in which the discharge-roller support frame 73 is located at the first position, the discharge-roller support frame 73 is pivoted rearward about the first axis 101, so that the discharge-roller support frame 73 is moved to the second position.

On the other hand, when the pushing-operation receiving portion 73*b* is pushed forward in a state in which the discharge-roller support frame 73 is located at the second position, the discharge-roller support frame 73 is pivoted forward about the first axis 101, so that the discharge-roller support frame 73 is moved to the first position.

Mechanism for Changing Press-Contact Position of Presser Roller and Nip Position of Discharge Roller Pair in Conjunction with Opening and Closing of Rear Sheet-Discharge Tray A mechanism for changing the press-contact position of the presser roller 62 with respect to the heating roller 61 and the nip position C of the discharge roller pair in conjunction with each other may be configured as follows. The fixing portion 6 shown in FIGS. 7 and 8 is configured such that the press-contact position of the presser roller 62 with respect to the heating roller 61 and the nip position C of the discharge roller pair are changed in conjunction with each other by an opening and closing operation of the rear sheet-discharge tray 21.

Figure 7:
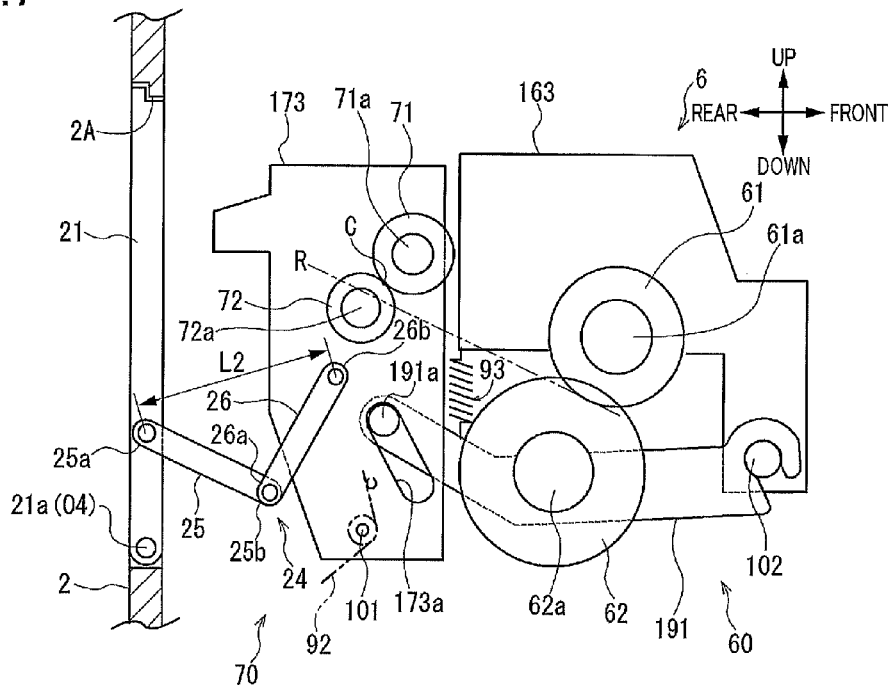
FIG. 7 is a side view in cross section of the fixing portion of an image forming apparatus in which an opening and closing operation of a rear sheet-discharge tray causes a movement of a presser roller between a first press-contact position and a second press-contact position and a change of a nip position of a discharge roller pair between a first nip position and a second nip position to be performed in conjunction with each other, the view showing a state in which the rear sheet-discharge tray is closed.
Figure 8:
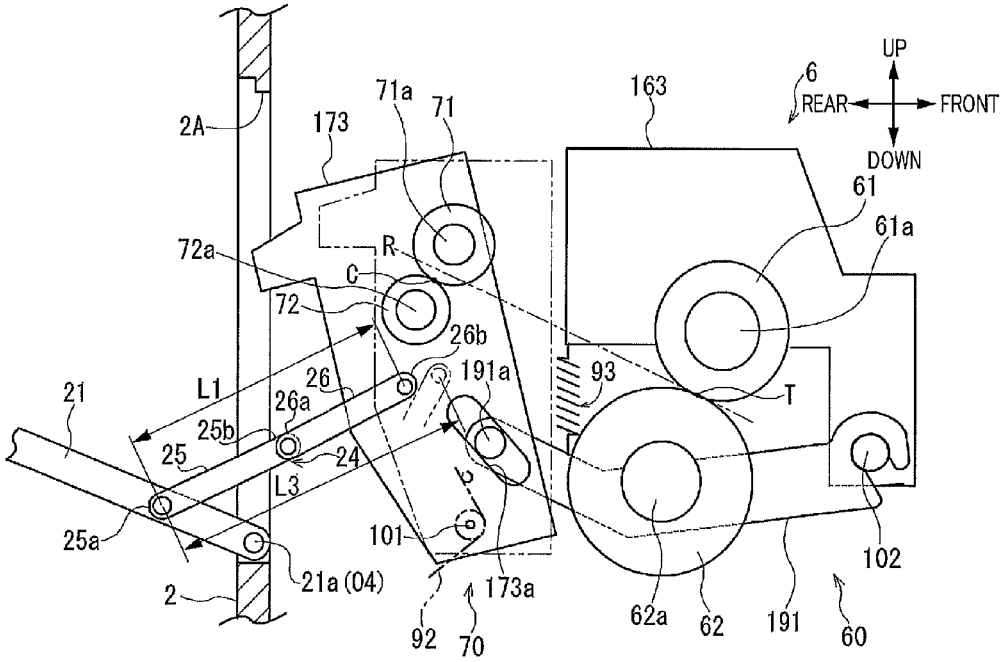
FIG. 8 is a side view in cross section of the fixing device of the image forming apparatus of FIG. 7, the view showing a state in which the rear sheet-discharge tray is opened.

In the configuration shown in FIGS. 7 and 8, the heating roller 61 is supported by a heating-roller support frame 163 so as to be rotatable about the first axis defined by the first rotation shaft 61*a*, and the first discharge roller 71 and the second discharge roller 72 are supported by a discharge-roller support frame 173 so as to be rotatable respectively about the third axis defined by the third rotation shaft 71*a* and the fourth axis defined by the fourth rotation shaft 72*a*.

The discharge-roller support frame 173 is pivotable about the first axis 101 so as to be movable between the first position and the second position. The discharge-roller support frame 173 is biased by the first biasing member 92 in a direction in which the discharge-roller support frame 173 pivots from the second position to the first position. An elongate hole 173*a* is formed in each side surface of the discharge-roller support frame 173 so as to extend in the up-down direction. The elongate hole 173*a* is inclined such that its upper end portion is located more rearward than its lower end portion. The elongate hole 173*a* is one example of "engaging portion" formed in the discharge-roller support frame 173 as one example of "first frame". The following explanation will be made focusing on one side surface of the discharge-roller support frame 173 shown in FIGS. 7 and 8.

One end of an arm 191 is supported by the heating-roller support frame 163. The arm 191 is pivotable about the second axis 102 located at the one end. The arm 191 extends rearward from the one end, and the presser roller 62 is supported by the arm 191 at its intermediate position so as to be rotatable about the second axis defined by the second rotation shaft 62*a*.

An engagement boss 191*a* is formed at a rear end of the arm 191, i.e., the other end of the arm 191, so as to protrude in the right-left direction. The engagement boss 191*a* is slidably engaged in the elongate hole 173*a* of the discharge-roller support frame 173. The engagement boss 191*a* is held in engagement with the elongate hole 173*a*, whereby the other end of the arm 191 is connected to the elongate hole 173*a* of the discharge-roller support frame 173. The arm 191 is biased by the second biasing member 93 in a direction in which the presser roller 62 moves from the second press-contact position to the first press-contact position.

Two pulling arms 24, each as one example of "link", are disposed between the discharge-roller support frame 173 and the rear sheet-discharge tray 21 at opposite end portions of the discharge-roller support frame 173 in the right-left direction. For the sake of brevity, the following explanation will be made focusing on one pulling arm 24. The pulling arm 24 has a first arm member 25 and a second arm member 26. The first arm member 25 is pivotally connected at its rear end, i.e., a first end 25*a*, to one side surface of the rear sheet-discharge tray 21. The second arm member 26 is pivotally connected at its front end, i.e., a second end 26*b*, to one side surface of the discharge-roller support frame 173.

The first arm member 25 and the second arm member 26 are connected to each other at a front end of the first arm member 25, i.e., a second end 25*b*, and a rear end of the second arm member 26, i.e., a first end 26*a*, such that the first arm member 25 and the second arm member 26 are pivotable relative to each other. The position at which the second end 26*b* of the second arm member 26 is connected to the discharge-roller support frame 173 is higher than the first axis 101.

When the pulling arm 24 takes an extended posture in which the first end 25*a* of the first arm member 25, the connection of the first arm member 25 and the second arm member 26, and the second end 26*b* of the second arm member 26 align with each other on one straight line and in which the first end 25*a* of the first arm member 25 and the second end 26*b* of the second arm member 26 are distant from each other to the largest extent, a distance between the first end 25*a* of the first arm member 25 and the second end 26*b* of the second arm member 26 is equal to L1 (FIG. 8). The distance L1 is larger than a distance L2 (FIG. 7) between the first end 25*a* and the second end 26*b* in a state in which the rear sheet-discharge tray 21 is closed.

Thus, when the rear sheet-discharge tray 21 is located at the closed position, the pulling arm 24 takes a bent (contracted) posture in which the first arm member 25 and the second arm member 26 are pivoted about the connection thereof. In this instance, the discharge-roller support frame 173 is biased by the first biasing member 92 so as to be located at the first position (FIG. 7). When the discharge-roller support frame 173 is located at the first position, the nip position C of the discharge roller pair is located at the first nip position. Subsequently when the rear sheet-discharge tray 21 is moved to the open position, the distance between the first end 25*a* and the second end 26*b* becomes larger than the distance L2.

Here, a distance between: the connected position of the second end 26*b* of the second arm member 26 and the discharge-roller support frame 173 when the discharge-roller support frame 173 is located at the first position; and the connected position of the first end 25*a* of the first arm member 25 and the discharge-roller support frame 173 when the discharge-roller support frame 173 is located at the second position is equal to L3 (FIG. 8). The distance L3 is set to be larger than the distance L1 between the first end 25*a* and the second end 26*b* of the pulling arm 24 when the pulling arm 24 takes the extended posture.

In this configuration, the posture of the pulling arm 24 changes to the extended posture during the movement of the rear sheet-discharge tray 21 from the closed position to the open position. After the pulling arm 24 has taken the extended posture and the rear sheet-discharge tray 21 is further opened so as to finally reach the open position, the discharge-roller support frame 173 is pulled by the pulling arm 24 and pivots downward about the first axis 101 against the biasing force of the first biasing member 92, so that the discharge-roller support frame 173 is moved to the second position.

That is, the discharge-roller support frame 173 is pulled by a pulling force of the pulling arm 24 in accordance with the movement of the rear sheet-discharge tray 21 to the open position to open the opening 2A, so that the discharge-roller support frame 173 pivots from the first position to the second position. The pivotal movement of the discharge-roller support frame 173 from the first position to the second position causes the nip position C to be changed from the first nip position to the second nip position.

When the discharge-roller support frame 173 pivots from the first position to the second position, the engagement boss 191*a* of the arm 191 is pushed by an inner circumferential surface of the elongate hole 173 of the discharge-roller support frame 173, whereby the engagement boss 191*a* slides downward in the elongate hole 173*a*. The downward sliding movement of the engagement boss 191*a* in the elongate hole 173*a* causes the arm 191 to pivot about the second axis 102, against the biasing force of the second biasing member 93, in a direction in which the second rotation shaft 62*a* of the presser roller 62 moves away from the first rotation shaft 61*a* of the heating roller 61. As a result, the position of the presser roller 62 supported by the arm 191 changes from the first press-contact position to the second press-contact position.

In other words, the discharge-roller support frame 173 pivots from the first position to the second position in accordance with the movement of the rear sheet-discharge tray 21 from the closed position to the open position, so that the movement of the presser roller 62 from the first press-contact position to the second press-contact position and the change of the nip position C from the first nip position to the second nip position are performed in conjunction with each other.

On the other hand, when the rear sheet-discharge tray 21 is moved from the open position to the closed position, the pulling arm 24 no longer pulls the discharge-roller support frame 173. As a result, the discharge-roller support frame 173 pivots from the second position to the first position by the biasing force of the first biasing member 92. Thus, the movement of the presser roller 62 from the second press-contact position to the first press-contact position and the change of the nip position C from the second nip position to the first nip position are performed in conjunction with each other.

Advantageous Effects

The image forming apparatus 1 according to the present embodiment is configured as follows. The image forming apparatus 1 includes: the fixing device including the heating roller 61 and the presser roller 62; the discharge-roller unit 70 including the discharge-roller support frame 73 configured to be movable between the first position and the second position and the discharge roller pair supported by the discharge-roller support frame 73 and including the first discharge roller 71 disposed so as to come into contact with one surface of a sheet that has contacted the heating roller 61 and the second discharge roller 72 disposed so as to come into contact with the other surface of the sheet that has contacted the presser roller 62; and the arm 91 supporting one of the heating roller 61 and the presser roller 62 while being coupled to the discharge-roller support frame 73 and configured to move the one of the heating roller 61 and the presser roller 62 in accordance with a movement of the discharge-roller support frame 73. When the discharge-roller support frame 73 is located at the first position, the nip position of the discharge roller pair is located at the first nip position and the arm 91 supports the one of the heating roller 61 and the presser roller 62 at the first press-contact position so as to permit the heating roller 61 and the presser roller 62 to be held in pressing contact with each other at the predetermined pressure. When the discharge-roller support frame 73 is located at the second position, the nip position of the discharge roller pair is located at the second nip position which is shifted from the first nip position in a direction from the heating roller 61 toward the presser roller 62, and the arm 91 supports the one of the heating roller 61 and the presser roller 62 at the second press-contact position so as to permit the heating roller 61 and the presser roller 62 to be held in pressing contact with each other at the pressure lower than the predetermined pressure.

According to the image forming apparatus 1 constructed as described above, the switching of the press-contact state of the heating roller 61 and the presser roller 62 from the state in which the two rollers 61, 62 are held in pressing contact with each other at the predetermined pressure to the state in which the two rollers 61, 62 are held in pressing contact with each other at the pressure lower than the predetermined pressure is linked, through the arm 91, with the switching of the nip position of the discharge roller pair from the first nip position to the second nip position shifted from the first nip position toward the presser roller 62. It is consequently possible to reduce the amount of curl of the sheet S on which an image has been thermally fixed, without performing the switching of the press-contact state of the heating roller 61 and the presser roller 62 and the switching of the nip position of the discharge roller pair separately or independently of each other. Thus, the amount of the curl of the sheet S is reduced with a simplified operation.

Where the reference plane R is defined as the plane (a) which is perpendicular to the plane P that includes the axis of the heating roller 61 and the axis of the presser roller 62 in the state in which the arm 91 supports the one of the heating roller 61 and the presser roller 62 at the second press-contact position and (b) which includes the contact point T at which the heating roller 61 and the presser roller 62 are in contact with each other, the first nip position is located on one side of the reference plane R that is nearer to the heating roller 61, and the second nip position is located such that the distance between the second nip position and the reference plane R is smaller than the distance between the first nip position and the reference plane R.

According to the image forming apparatus 1 constructed as described above, the sheet S discharged from the press-contact position between the heating roller 61 and the presser roller 62 is conveyed by the first discharge roller 71 and the second discharge roller 72 without being largely bent, so that the amount of curl of the sheet S can be reduced.

The image forming apparatus 1 of FIGS. 7 and 8 further includes the heating-roller support frame 163 supporting the heating roller 61. The discharge-roller support frame 173 has the elongate hole 173*a*, as the engaging portion, and is configured to pivot about the first axis 101 so as to be movable between the first position and the second position. The arm 191 is supported at one end thereof by the heating-roller support frame 163 so as to be pivotable about the one end, and the arm is engaged at the other end thereof with the elongate hole 173*a*.

According to the image forming apparatus 1 constructed as described above, the arm 191 connected to the elongate hole 173*a* of the discharge-roller support frame 173 pivots in accordance with the movement of the discharge-roller support frame 173 between the first position and the second position, whereby the presser roller 62 supported by the arm 191 can be moved between the first press-contact position and the second press-contact position.

The image forming apparatus 1 further includes: the sheet discharge tray 23*a*; and the housing 2 in which the fixing device and the discharge-roller unit 70 are housed and which has the opening 2A through which the sheet S conveyed by the discharge roller pair is discharged to an outside of the housing 2. When the discharge-roller support frame 73 is located at the first position, the nip position is located at the first nip position and the sheet S is discharged to the sheet discharge tray 23*a* by the discharge roller pair. When the discharge-roller support frame 73 is located at the second position, the nip position is located at the second nip position and the sheet S is discharged by the discharge roller pair to the outside of the housing 2 through the opening 2A.

According to the image forming apparatus 1 constructed as described above, when the nip position C of the discharge roller pair is located at the first nip position, the sheet S conveyed by the first discharge roller 71 and the second discharge roller 72 is discharged to the sheet discharge tray 23*a*, ensuring good conveyance of the sheet S. When the nip position C is located at the second nip position, the sheet S conveyed downstream by the first discharge roller 71 and the second discharge roller 72 is discharged to the rear sheet-discharge tray 21, so that the sheet S can be discharged to the outside of the housing 2 without being largely bent, ensuring good conveyance of the sheet S when the nip position C is located at the second nip position.

In the image forming apparatus 1, the housing 2 includes the rear sheet-discharge tray 21 configured to pivot between the closed position at which the rear sheet-discharge tray 21 closes the opening 2A and the open position at which the rear sheet-discharge tray 21 opens the opening 2A. The image forming apparatus 1 of FIGS. 7 and 8 further includes the pulling arm 24 disposed between the rear sheet-discharge tray 21 and the discharge-roller support frame 173. The discharge-roller support frame 173 is configured to move from the first position to the second position by the pulling force of the pulling arm 24 generated when the rear sheet-discharge tray 21 opens the opening 2A.

According to the image forming apparatus 1 of FIGS. 7 and 8 constructed as described above, the discharge-roller support frame 173 pivots from the first position to the second position in accordance with the movement of the rear sheet-discharge tray 21 from the closed position to the open position. Thus, the movement of the presser roller 62 from the first press-contact position to the second press-contact position and the change of the nip position C from the first nip position to the second nip position can be performed in conjunction with each other.

In the image forming apparatus 1, the discharge-roller support frame 73 includes the pushing-operation receiving portion 73*b*, and the discharge-roller support frame 73 moves from the first position to the second position by a pushing operation on the pushing-operation receiving portion 73*b*.

According to the image forming apparatus 1 constructed as described above, the pushing-operation receiving portion 73*b* is pushed, so that the discharge-roller support frame 73 pivots from the first position to the second position. Consequently, the switching of the press-contact position of the presser roller 62 from the first press-contact position to the second press-contact position and the change of the nip position C of the discharge roller pair from the first nip position to the second nip position can be performed in conjunction with each other.

In the image forming apparatus 1, the discharge-roller support frame 73 includes the guide 74 including the first guide member 74*a* and the second guide member 74*b*. The guide 74 is configured to guide, to the nip position of the discharge roller pair, the sheet S discharged from the fixing device. The guide 74 is constructed such that the distance between the first guide member 74*a* and the second guide member 74*b* gradually becomes smaller toward the downstream side in the sheet conveyance direction.

According to the image forming apparatus 1 constructed as described above, the sheet S discharged from the fixing unit 60 is guided by the guide 74 to the nip position C, making it possible to smoothly convey the sheet S while being nipped by the first discharge roller 71 and the second discharge roller 72.

In the image forming apparatus 1, the heating roller 61 is supported by the heating-roller support frame 63 so as to be rotatable about the first rotation axis defined by the first rotation shaft 61*a*, and the presser roller 62 is supported by the arm 91 so as to be rotatable about the second rotation axis defined by the second rotation shaft 62*a*. The discharge-roller support frame 73 supports the first discharge roller 71 and the second discharge roller 72 so as to be rotatable respectively about the third rotation axis defined by the third rotation shaft 71*a* and the fourth rotation axis defined by the fourth rotation shaft 72*a*. The image forming apparatus 1 further includes: the first biasing member 92 biasing the discharge-roller support frame 73 in a direction in which the discharge-roller support frame 73 moves from the second position to the first position; the second biasing member 93 biasing the arm 91 in a direction in which the presser roller 62 moves in a direction from the second press-contact position to the first press-contact position; the first cam 97*a* configured to come into engagement with the heating-roller support frame 63 so as to permit the presser roller 62 to be kept located at the first press-contact position; the second cam 97*b* configured to come into engagement with the heating-roller support frame 63 so as to permit the presser roller 62 to be kept located at the second press-contact position; the engagement boss 98 configured to be pivotable about the third axis 103 and to come into engagement with the discharge-roller support frame 73 so as to permit the discharge-roller support frame 73 to be kept located at one of the first position and the second position; and the operation arm 95 supported by the arm 91 so as to be pivotable about the third axis 103.

According to the image forming apparatus 1 constructed as described above, by moving the operation arm 95 between the position at which the first cam 97*a* is held in engagement with the stopper portion 63*b* and the position at which the second cam 97*b* is held engagement with the stopper portion 63*b*, the switching of the nip position C of the discharge roller pair between the first nip position and the second nip position and the switching of the press-contact position of the presser roller 62 between the first press-contact position and the second press-contact position can be performed in conjunction with each other through the arm 91.

What is claimed is:

1. An image forming apparatus of an electrophotographic type, comprising:

a fixing device including a heater and a presser;

a discharge-roller unit including a first frame configured to be movable between a first position and a second position and a discharge roller pair supported by the first frame, the discharge roller pair including a first roller disposed so as to come into contact with one surface of a sheet that has contacted the heater and a second roller disposed so as to come into contact with the other surface of the sheet that has contacted the presser; and an arm supporting one of the heater and the presser while being coupled to the first frame, the arm being configured to move the one of the heater and the presser in accordance with a movement of the first frame, wherein, when the first frame is located at the first position, a nip position of the discharge roller pair is located at a first nip position and the arm supports the one of the heater and the presser at a first press-contact position so as to permit the heater and the presser to be held in pressing contact with each other at a predetermined pressure, and wherein, when the first frame is located at the second position, the nip position of the discharge roller pair is located at a second nip position which is shifted from the first nip position in a direction from the heater toward the presser, and the arm supports the one of the heater and the presser at a second press-contact position so as to permit the heater and the presser to be held in pressing contact with each other at a pressure lower than the predetermined pressure.

2. The image forming apparatus according to claim 1, wherein, where a reference plane is defined as a plane (a) which is perpendicular to a plane that includes an axis of the heater and an axis of the presser in a state in which the arm supports the one of the heater and the presser at the second press-contact position and (b) which includes a contact point at which the heater and the presser are in contact with each other, the first nip position is located on one side of the reference plane that is nearer to the heater, and the second nip position is located such that a distance between the second nip position and the reference plane is smaller than a distance between the first nip position and the reference plane.

3. The image forming apparatus according to claim 1, further comprising a second frame supporting the heater, wherein the first frame has an engaging portion and is configured to pivot about an axis so as to be movable between the first position and the second position, and wherein the arm is supported at one end thereof by the second frame so as to be pivotable about the one end, and the arm is engaged at the other end thereof with the engaging portion.

4. The image forming apparatus according to claim 1, further comprising: a sheet discharge tray; and a housing in which the fixing device and the discharge-roller unit are housed and which has an opening through which the sheet conveyed by the discharge roller pair is discharged to an outside of the housing, wherein, when the first frame is located at the first position, the nip position is located at the first nip position and the sheet is discharged to the sheet discharge tray by the discharge roller pair, and wherein, when the first frame is located at the second position, the nip position is located at the second nip position and the sheet is discharged by the discharge roller pair to the outside of the housing through the opening.

5. The image forming apparatus according to claim 4, wherein the housing includes a cover configured to pivot between a closed position at which the cover closes the opening and an open position at which the cover opens the opening, wherein the image forming apparatus further includes a link disposed between the cover and the first frame, and wherein the first frame is configured to move from the first position to the second position by a pulling force of the link generated when the cover opens the opening.

6. The image forming apparatus according to claim 1, wherein the first frame includes a pushing-operation receiving portion, and wherein the first frame moves from the first position to the second position by a pushing operation on the pushing-operation receiving portion.

7. The image forming apparatus according to claim 1, wherein the first frame includes a guide including a first guide member and a second guide member, the guide being configured to guide, to the nip position of the discharge roller pair, the sheet discharged from the fixing device, and wherein a distance between the first guide member and the second guide member gradually becomes smaller toward a downstream side in a conveyance direction of the sheet.

8. The image forming apparatus according to claim 1, wherein the heater is a heating roller supported by a second frame so as to be rotatable about a first rotation axis, wherein the presser is a presser roller supported by the arm so as to be rotatable about a second rotation axis, wherein the first frame supports the first roller and the second roller of the discharge roller pair so as to be rotatable respectively about a third rotation axis and a fourth rotation axis, wherein the image forming apparatus further comprises:

a first biasing member biasing the first frame in a direction in which the first frame moves from the second position to the first position;

a second biasing member biasing the arm in a direction in which the presser moves in a direction from the second press-contact position toward the first press-contact position, a first cam configured to come into engagement with the second frame so as to permit the presser to be kept located at the first press-contact position;

a second cam configured to come into engagement with the second frame so as to permit the presser to be kept located at the second press-contact position;

a position keeper configured to be pivotable about a pivotal axis and to come into engagement with the first frame so as to permit the first frame to be kept located at one of the first position and the second position; and an operation arm supported by the arm so as to be pivotable about the pivotal axis.

* * * * *